US008154498B2

(12) United States Patent
Katayama et al.

(10) Patent No.: US 8,154,498 B2
(45) Date of Patent: Apr. 10, 2012

(54) DISPLAY DEVICE

(75) Inventors: Yukari Katayama, Chigasaki (JP); Yasuyuki Kudo, Fujisawa (JP); Norio Mamba, Kawasaki (JP); Toshimitsu Matsudo, Tokyo (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 846 days.

(21) Appl. No.: 11/583,880

(22) Filed: Oct. 20, 2006

(65) Prior Publication Data

US 2007/0091050 A1 Apr. 26, 2007

(30) Foreign Application Priority Data

Oct. 20, 2005 (JP) ..... 2005-306003

(51) Int. Cl.
*G09G 3/36* (2006.01)

(52) U.S. Cl. ..... 345/100; 345/98

(58) Field of Classification Search ..... 345/98–100
See application file for complete search history.

(56) References Cited

U.S. PATENT DOCUMENTS

| | | | | |
|---|---|---|---|---|
| 6,496,174 | B2 * | 12/2002 | Kurumisawa et al. | 345/98 |
| 6,801,194 | B2 | 10/2004 | Miyazawa et al. | |
| 7,091,937 | B2 | 8/2006 | Nakamura | |
| 7,333,096 | B2 | 2/2008 | Washio et al. | |
| 7,388,579 | B2 * | 6/2008 | O'Gorman et al. | 345/211 |
| 2003/0179335 | A1 * | 9/2003 | Sato et al. | 349/149 |
| 2004/0160404 | A1 | 8/2004 | Nakajima et al. | |
| 2005/0146492 | A1 * | 7/2005 | Baba et al. | 345/87 |
| 2005/0156862 | A1 | 7/2005 | Hirayama et al. | |
| 2009/0146939 | A1 * | 6/2009 | Hirayama et al. | 345/98 |

FOREIGN PATENT DOCUMENTS

| | | |
|---|---|---|
| JP | 2002-215118 | 7/2002 |
| JP | 2003-005727 | 1/2003 |
| JP | 2003-029715 | 1/2003 |
| JP | 2003-157051 | 5/2003 |
| JP | 2003-222891 | 8/2003 |
| JP | 2003-248468 | 9/2003 |
| JP | 2003-255904 | 9/2003 |
| JP | 2003-323160 | 11/2003 |
| JP | 2005-195703 | 7/2005 |

OTHER PUBLICATIONS

Office Action in JP 2005-306003, dated Dec. 21, 2010 (3 pages, in Japanese); (English language translation, 3 pages).

* cited by examiner

*Primary Examiner* — Amr Awad
*Assistant Examiner* — Randal Willis
(74) *Attorney, Agent, or Firm* — Antonelli, Terry, Stout & Kraus, LLP.

(57) ABSTRACT

In a display device using an RGB time division drive system in which RGB data to be supplied to display pixels of three colors RGB are subjected to time-division multiplexing and input to a liquid crystal panel unit, (1) data are input to the liquid crystal panel unit alternately in the order of RGB and BGR every line signal, and a selection signal SC which is in the on-state at a break of one line period is kept in the on-state until the next line period. In addition, (2) over a partial non-display period in partial display, selection signals SA, SB and SC are always in the off-state and an equalize signal EQG is in the on-state.

6 Claims, 11 Drawing Sheets

DISPLAY DEVICE

INCORPORATION BY REFERENCE

The present application claims priority from Japanese application serial no. 2005-306003 filed on Oct. 20, 2005, the content of which is hereby incorporated by reference into this application.

BACKGROUND OF THE INVENTION

The present invention relates to display devices with low power consumption. In particular, the present invention relates to display devices using liquid crystal elements, EL elements or plasma.

In small-sized liquid crystal displays used in mobile phones or the like, it is important to hold down the power consumption to a small value. In a system proposed in JP-A-2003-5727, therefore, it is attempted to reduce power consumption by displaying only a part of the liquid crystal display and preventing other parts from being displayed at the time of waiting. Hereafter, such a system in which only a part of the display is displayed is referred to as partial display. In JP-A-2003-5727, the drive frequency per frame is lowered and the power consumption is lowered by dividing scanning of the non-display parts into several frames.

On the other hand, TFTs (Thin Film Transistors) are typically used in the small-sized liquid crystal displays currently used in mobile phones. As a conventional TFT material, amorphous silicon is used. Although amorphous silicon has a merit that the manufacturing cost is low, its electron mobility is slow. Therefore, an external LSI is used for the liquid crystal drive circuit. In recent years, LTPS (Low Temperature Poly Silicon) having great electron mobility has been developed, and it has become possible to take the drive circuit and so on into a liquid crystal panel. In a system proposed in U.S. Pat. No. 6,801,194 (JP-A-2002-215118), therefore, the number of components is reduced and the cost is reduced by taking a scanning line drive circuit into the liquid crystal panel.

Furthermore, in a system proposed in JP-A-2003-255904, signals supplied to liquid crystal elements of three colors RGB (Red, Green and Blue) are input to the liquid crystal panel in a time division manner and the cost is reduced by thus reducing the number of connection wires. Hereafter, this system is referred to as RGB time division drive.

By introducing this RGB time division drive, however, an RGB distribution switch for distributing a signal supplied from one signal line in a liquid crystal panel to signal lines connected to liquid crystal elements respectively of R, G and B becomes necessary. Since this RGB distribution switch is operated in a horizontal period, power consumption is high. Therefore, even the partial display for reducing the power consumption has a problem that power consumption in the LTPS-TFT liquid crystal panel in which the RGB time division drive is adopted becomes greater than in the amorphous silicon TFT liquid crystal panel in which the RGB time division drive is not adopted.

In a technique proposed in JP-A-2003-029715 to solve the problem, power consumption is reduced in the partial display by turning on all RGB distribution switches when a signal is input to the non-display part and eliminating variations among control signals to the RGB distribution switches.

Furthermore, introduction of the RGB time division drive poses a problem that the electric charge quantities leaked from respective signal lines become uneven and flicker is generated. In a technique proposed in U.S. Patent Publication No. 2005/156862 (JP-A-2005-195703) to solve this problem, application order of the display signal voltage to respective signal lines is inverted every horizontal period.

Furthermore, in a system proposed in U.S. Patent Publication No. 2003/179335 (JP-A-2003-222891), an equalizer circuit is provided to improve the voltage writing efficiency on the drain signal line and reduce the power dissipation caused by reduction in the driver output load.

SUMMARY OF THE INVENTION

The technique proposed in JP-A-2003-029715 has a problem that reduction of power consumption of an amplifier for driving a signal line is not taken into consideration and the power consumption cannot be reduced very much. The technique proposed in U.S. Patent Publication No. 2005/156862 has a problem that reduction of power consumption is not taken into consideration and the power consumption cannot be reduced very much.

In order to solve the problems, an object of the present invention is to reduce power consumption in a display device using an LTPS-TFT liquid crystal panel with the RGB time division drive introduced therein.

The object is achieved by the present invention as described hereafter. The order of the RGB selection signals for selecting RGB distribution switches is changed every horizontal period, for example, from RGB to BGR. In addition, at a break of one horizontal period, a selection signal selected lastly, for example, a B selection signal is kept in the selected state to lower the frequency of the B selection signal. As a result, low power consumption is achieved.

The object is achieved by the present invention as described hereafter. At the time of signal input for the non-display part in the partial display, voltage writing into the drain signal lines is conducted with all RGB distribution switches in the off-state and an equalizer circuit in the on-state, and power supplies for amplifiers for driving the drain signal lines are disconnected. As a result, lower power consumption is achieved.

As heretofore described, the power consumption of the display device can be reduced by lowering the frequency of the selection signals supplied to the RGB distribution switches, even in display devices using an LTPS-TFT liquid crystal panel.

The present invention can be embodied by only changing the order of inputting the RGB selection signals input to the liquid crystal panel. In the partial display, therefore, there is an effect that the position and range of the display part and the non-display part in the liquid crystal panel can be changed freely.

Other objects, features and advantages of the invention will become apparent from the following description of the embodiments of the invention taken in conjunction with the accompanying drawings.

DESCRIPTION OF THE EMBODIMENTS

First Embodiment

Figure 1:
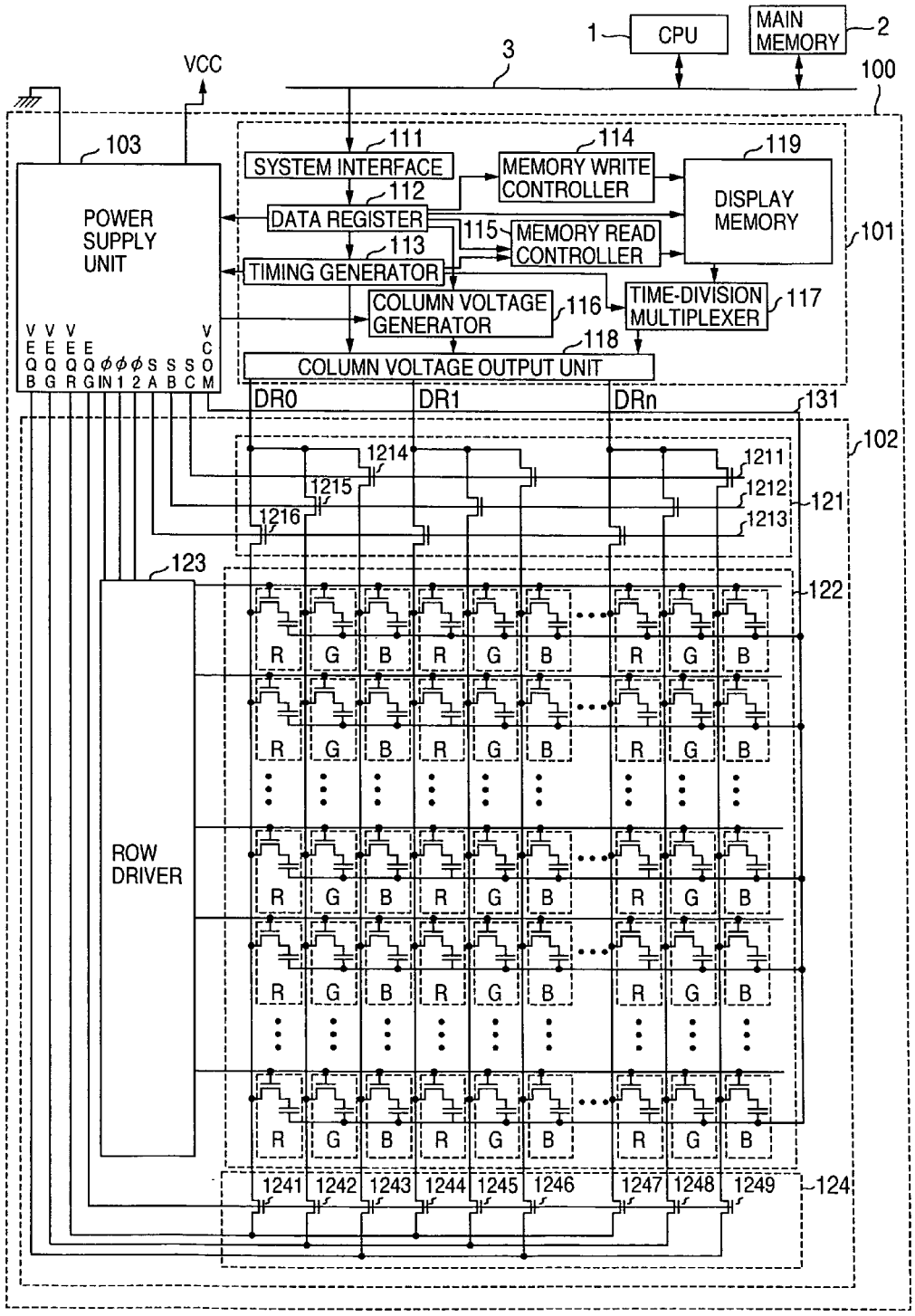
FIG. 1 is a block diagram showing a configuration of first and second embodiments of a display device according to the present invention.

Hereafter, a first embodiment of the present invention will be described. FIG. 1 is a block diagram of a display device in the present embodiment. Reference numeral 100 denotes a display device, 101 a column driver, 102 a panel unit, and 103 a power supply unit.

In the column driver 101 shown in FIG. 1, reference numeral 111 denotes a system interface, 112 a data register, 113 a timing generator, 114 a memory write controller, 115 a memory card controller, 116 a column voltage generator, 117 a time-division multiplexer, 118 a column voltage output unit, and 119 a display memory.

In the panel unit 102 shown in FIG. 1, reference numeral 121 a distributor, 122 a pixel unit, 123 a row driver, and 124 an equalizer circuit. These are, for example, low temperature polysilicon TFT elements, and formed integrally on a glass substrate.

In the distributor 121 in this panel unit 102, reference numerals 1214, 1215 and 1216 denote TFT elements. In the equalizer circuit 124, reference numerals 1241 to 1249 denote TFT elements.

In the pixel unit 122 in the panel unit 102, a three-terminal switching element is formed at each of intersections of a plurality of row electrodes and a plurality of column electrodes. A first terminal of the switching element is connected to a row electrode. A second terminal is connected to a column electrode. A third terminal is connected to one end of a liquid crystal layer and retained capacitance which is not illustrated. The other end of the liquid crystal layer is connected to a common electrode 131.

Each of display elements driven by the pixel unit 122 is, for example, liquid crystal of TN type. Display is conducted by applying a predetermined voltage level. Display data input to the display device is 8-bit digital data for each of R (red), G (green) and B (blue). However, the number of bits for each color is not restricted to this.

The column driver 101 and the power supply unit 103 may be formed of a single-chip LSI. As a matter of fact, the column driver 101 and the power supply unit 103 are formed of a single-chip LSI in many cases.

Operation conducted in the display device shown in FIG. 1 will now be described with reference to FIG. 2. First, operation of the column driver 101 will now be described.

Control data for controlling operation of the display device is supplied from a CPU 1 which is an external device to the column driver 101 via a system bus 3. Display data, and data concerning its display position, the number of drive lines, the frame frequency and so on are included in the control data.

The system interface 111 writes control data into an address in the data register 112 specified by the CPU 1. Various control data stored in the data register 112 are output to respective blocks. For example, the display data is output to the display memory 119, the display position data is output to the memory write controller 114, and the data concerning the number of drive lines, the frame frequency and so on is output to the timing generator 113.

The memory write controller 114 decodes the display position data, and selects a bit line and a word line in the display memory 119 associated with the decoded display position data. Concurrently therewith, the memory write controller 114 outputs the display data from the data register 112 to the display memory 119, and completes write operation.

Figure 2:
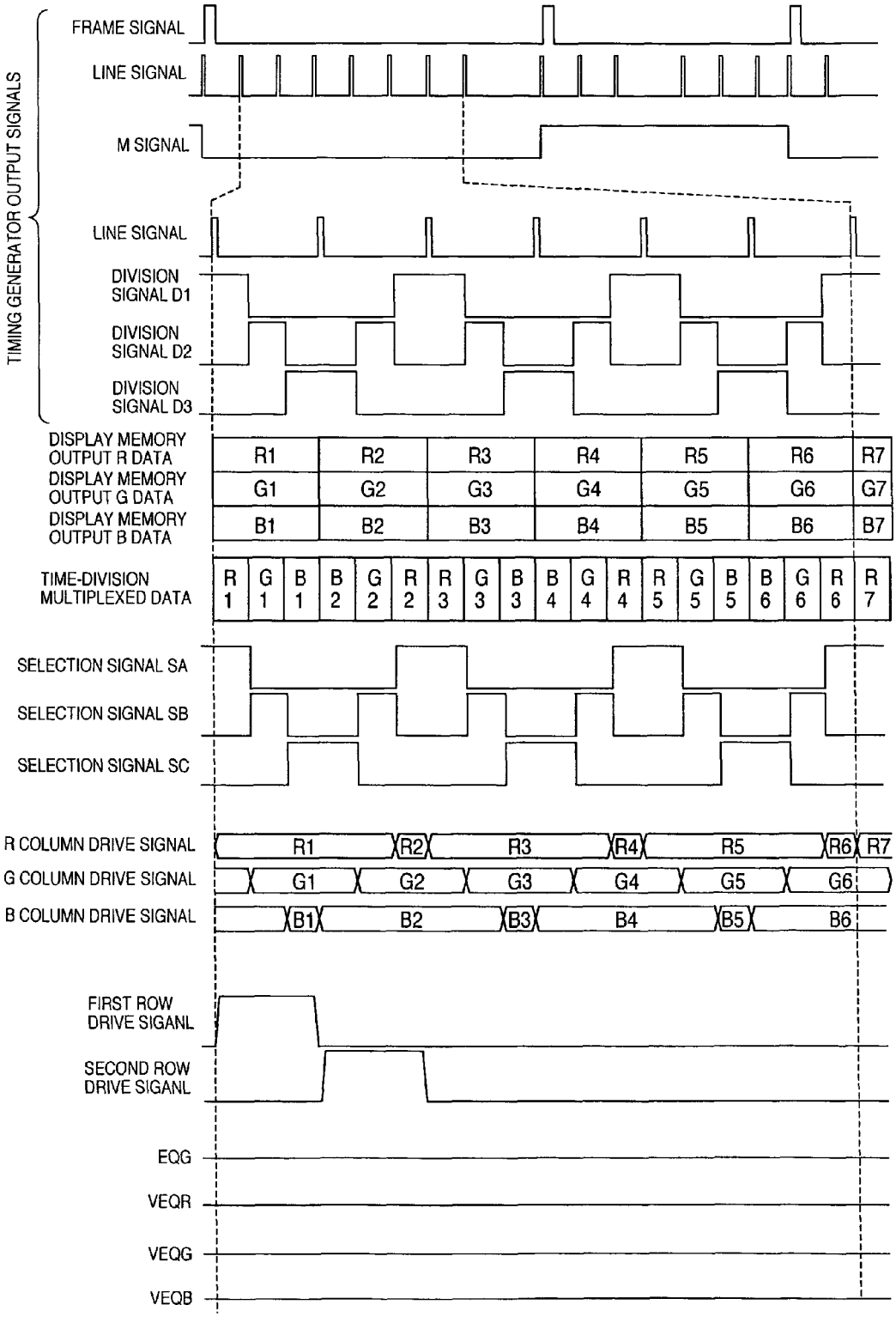
FIG. 2 is a timing chart showing operation conducted at the time of ordinary display in the first embodiment.

The timing generator 113 generates a timing signal group shown in FIG. 2 by itself on the basis of drive information supplied from the data register 112, and outputs the timing signal group to the memory read controller 115, the time-division multiplexer 117 and the column voltage output unit 118.

The memory read controller 115 decodes a signal output by the timing generator 113, and selects a pertinent word line in the display memory 119. In this operation, one row is selected successively, beginning with a word line associated with stored display data of head row on the screen. After a final row, return to the head line is conducted and the operation is repeated. Concurrently with the selection operation of the word line, display data associated with one row are successively output from data lines of the display memory 119 in bulk. Word line changeover timing is synchronized to a line signal supplied from the timing generator 113. Selection timing of the word line associated with the head row is synchronized to a frame signal supplied from the timing generator 113.

The time-division multiplexer 117 conducts time-division multiplexing on display data associated with one line supplied from the display memory 119. In this operation, each period of the line signal is divided into three parts by using division signals D1 to D3 shown in FIG. 2 supplied from the timing generator 113, and display data output from the display memory 119 are output as R data, G data and B data. At this time, the order of the R data, G data and B data is interchanged every line as indicated by time-division multiplexed data shown in FIG. 2. In other words, if the data are output in the order of RGB in a certain line, the data are output in the order of BGR in the next line. The data are output in the order of RGB in the further next line. The order of the R data, G data and B data is thus interchanged every line.

The column voltage generator 116 is a block for generating a column voltage required to convert time-division multiplexed data to a voltage level. In this block, a voltage associated with each digital data which is display data is generated. For example, since display data is represented by using 8 bits in the present embodiment, it becomes one of 256 kinds of data. In this block, 256 kinds of voltage ranging from V0 to V256 are produced by dividing a reference voltage with resistors. Here, V0 is a voltage associated with data 0, and V256 is a voltage associated with data 255.

The column voltage output unit 118 is a block which selects one level from among 256 kinds of column voltage according to an M signal supplied from the timing generator 113 and the time-division multiplexed data, enhances drive capability at the level by using an incorporated amplifier, and outputs the level. The M signal is a square wave of 50% duty which is used by the LCD to switch the polarity of the display driver voltage to ensure that there is no DC component applied across the LC cell. The amplifiers are provided for each of column drive signals DR0 to DRm, and their power consumption is very large because a DC current must be let flow through each of them stationarily.

Operation of the panel unit 120 will now be described. The pixel unit 122 includes three-terminal TFT elements, a liquid crystal layer, and retained capacitances. A drain terminal of each three-terminal TFT element is connected to a column electrode. A gate terminal is connected to a row electrode. A source terminal is connected to the liquid crystal layer and a retained capacitance which is not illustrated. There is a common electrode on the opposite side of the liquid crystal layer from the row and column electrodes. The common electrode is electrically connected to the liquid crystal layer. In addition, the other terminal of the retained capacitance is connected to an electrode called storage line which is not illustrated. In order to implement this configuration, for example, the column electrodes, the row electrodes and the storage lines are formed in a matrix form on an inner surface of one of two transparent substrates which retain the liquid crystal layer and the common electrode is formed on an inner surface of the other transparent substrate. By the way, this circuit configuration of pixels is a configuration of the so-called Cst structure. However, a configuration of the so-called Cadd structure in which the other terminal of the retained capacitance is connected to a row electrode of a previous stage may also be used.

The distributor 121 is a block which distributes (demultiplexes) the column voltage supplied from the column driver 101 and outputs the distributed column voltage to column electrodes in the pixel unit 122. The distributor 121 can be implemented by using a circuit configuration including switches of the TFT elements 1216, 1215 and 1214. As for the operation, selection signals SA, SB and SC shown in FIG. 2 are supplied to distribution control lines 1213, 1212 and 1211, respectively. In a state in which a selection signal is at a high level (also referred to as "H" hereafter), the switch turns on, and a column voltage is applied to the column electrode. By the way, the selection signals SA to SC are supplied from the power supply unit 103 which will be described later. The distributor in the present embodiment will be described supposing that the distributor is a switch circuit in which one TFT element is used as each switch. However, each switch in the switch circuit is not restricted to this, but it may be a switch formed of a combination of at least two MOS transistors such as CMOS transistors, or a switch having any other configuration, as long as it is a switch capable of transferring a voltage level.

The row driver 123 applies an "H" row voltage to a head row electrode in synchronism with the frame signal transferred from the timing generator 113 in the column driver 101. Thereafter, the row driver 123 successively applies the "H" row voltage to the row electrode of the next stage in synchronism with the transferred line signal. By the way, the operation of the row driver 123 can be implemented easily by using a shift register circuit.

The equalizer circuit 124 includes the TFT elements 1241 to 1249. When an equalizing signal (hereafter "EQG signal") supplied from the power supply unit 103 is "H," a VEQR signal is supplied to a column electrode connected to liquid crystal elements of the R color, a VEQG signal is supplied to a column electrode connected to liquid crystal elements of the G color, and a VEQB signal is supplied to a column electrode connected to liquid crystal elements of the B color. At the time of ordinary display in the present embodiment, the EQG signal is always kept at a low level (also referred to as "L" hereafter) and the column electrodes are intercepted from the VEQR, VEQG and VEQB signals.

Operation of the power supply unit 103 will now be described. The power supply unit 103 generates a common voltage VCOM which is applied to the common electrode 131, a storage voltage applied to a storage line which is not illustrated, clocks ϕ1 and ϕ2 input to the row driver 123, a shift register start signal ϕIN for the row driver 123, the selection signals SA to SC, the EQG signal, and the VEQR, VEQG and VEQB signals.

First, in generation of the common voltage VCOM, the power supply unit 103 converts the M signal transferred from the timing generator 113 to a level required for liquid crystal drive, and outputs a resultant signal. The conversion is conducted so as to typically make the common voltage VCOM larger in amplitude than the column voltage. Since the polarity of the voltage applied to the liquid crystal is the polarity of the column voltage seen from the common voltage, the polarity of the voltage applied to the liquid crystal is inverted according to the M signal. Although the M signal shown in FIG. 2 is associated with the frame inversion drive, the period of the M signal is not restricted to this.

As for the storage voltage, the M signal transferred from the timing generator 113 is converted to the same level as the common voltage and a resultant signal is output. Since the common electrode is connected directly to the liquid crystal element and wired widely in a plane form, noise easily gets on the common electrode. As for the storage line, wiring is divided from row to row and it is connected to large retained capacitance, resulting in stability. The storage line has a function of stabilizing the liquid crystal display.

The clocks ϕ1 and ϕ2 input to the row driver 123 are two-phase clocks inverted by the line signal transferred from the timing generator 113. The "H" level of the two-phase clocks is equal to the "H" level of the gate signal. The "L" level of the two-phase clocks is equal to the "L" level of the gate signal. The shift register start signal ϕIN is a signal which is synchronized to the frame signal transferred from the timing generator 113 and which becomes "H" during only one period of the two-phase clocks ϕ1 and ϕ2.

The selection signals SA to SC are generated on the basis of the division signals D1 to D3. It is supposed that the "H" of the selection signals SA to SC is a voltage level which turns on the TFT elements 1214, 1215 and 1216 in the distributor 121 and the "L" of the selection signals SA to SC is a voltage level which turns off the TFT elements 1214, 1215 and 1216. The selection signals SA to SC have waveforms shown in FIG. 2. If the column voltage is applied in the order of RGB in a first row (a certain row), therefore, the column voltage is applied in the order of BGR in a second row (the next row). In other words, a column selected lastly in a certain row is selected first in the next row. A selection signal which is "H" at a break between rows remains "H." It remains "H" until the first column selection is finished in the next row.

In this way, operation is conducted in the order of RGB, BGR, RGB, . . . . At the time of the ordinary operation, therefore, the operation frequency of the selection signals SA and SC becomes half as compared with the case where operation is conducted in the order of RGB, RGB, RGB, . . . . On the whole, therefore, the frequency of the selection signals can be made equal to ⅔. The power charged and discharged by the TFT elements in the distributor 121 can be reduced to ⅔.

Besides such operation, the power supply unit 103 generates power supply voltages required for the display device according to the present invention, and outputs them to respective blocks. The power supply unit 103 can be implemented by using, for example, means for boosting a power supply voltage supplied from the outside and means for adjusting the boosted voltage. It is supposed that voltage adjustment control information is transferred from the data register 112 in the column driver 101.

Operation of the present embodiment on the waiting screen, i.e., in the partial display will now be described with reference to FIGS. 3A and 3B and FIG. 4. The partial display is a system in which a part of the display device is in the non-display state and the power consumption is held down. In the present embodiment, the display screen is divided into three parts in the longitudinal direction as shown in FIG. 3B. A central part is used as a non-display region. Upper and lower parts are used as display regions. The display device in the present embodiment conducts the operation shown in FIG. 3A once in the first frame and the operation shown in FIG. 4 ($n$-1) times, and then repeats these operations.

First, the CPU 1 writes a non-display region start row number and a non-display region end row number into a non-display start address register and a non-display end address register incorporated in the data register 112 via the system interface 111. Thereafter, the CPU 1 sets a display start register incorporated in the data register 112 to a start state. If the display start register is set to the start state, the timing generator 113 starts counting in a counter incorporated therein. The counter is reset by the frame signal, and the count in the counter increases by one each time the line signal goes high. When the value in the counter is lower than a value set in the partial non-display start address register, the ordinary operation is conducted.

If the value in the counter incorporated in the timing generator 113 has become equal to the value in the non-display start address register, the timing generator 113 causes the division signals D1, D2 and D3 to go low in the first frame. Concurrently therewith, the timing generator 113 turns off power supplies for amplifiers in the column voltage output unit 118 and thereby prevents stationary currents from flowing to the amplifiers. The timing generator 113 causes the equalize signal EQG supplied to the equalizer circuit 124 to go high and fixes the VEQR, VEQG and VEQB signals to the potential level of the common electrode or a column voltage associated with "0." By doing so, the charging and discharging power becomes the lowest and it becomes possible to hold down the power dissipation to the minimum. Since the number of amplifiers is 240 in a panel unit having a QVGA size and 480 in a panel unit having a VGA size, the stationary currents of these amplifiers are reduced. In addition, since only three amplifiers in the power supply unit 103 for driving the VEQR, VEQG and VEQB signals are brought into the operation state, the power consumption can be reduced remarkably.

Figure 3A:
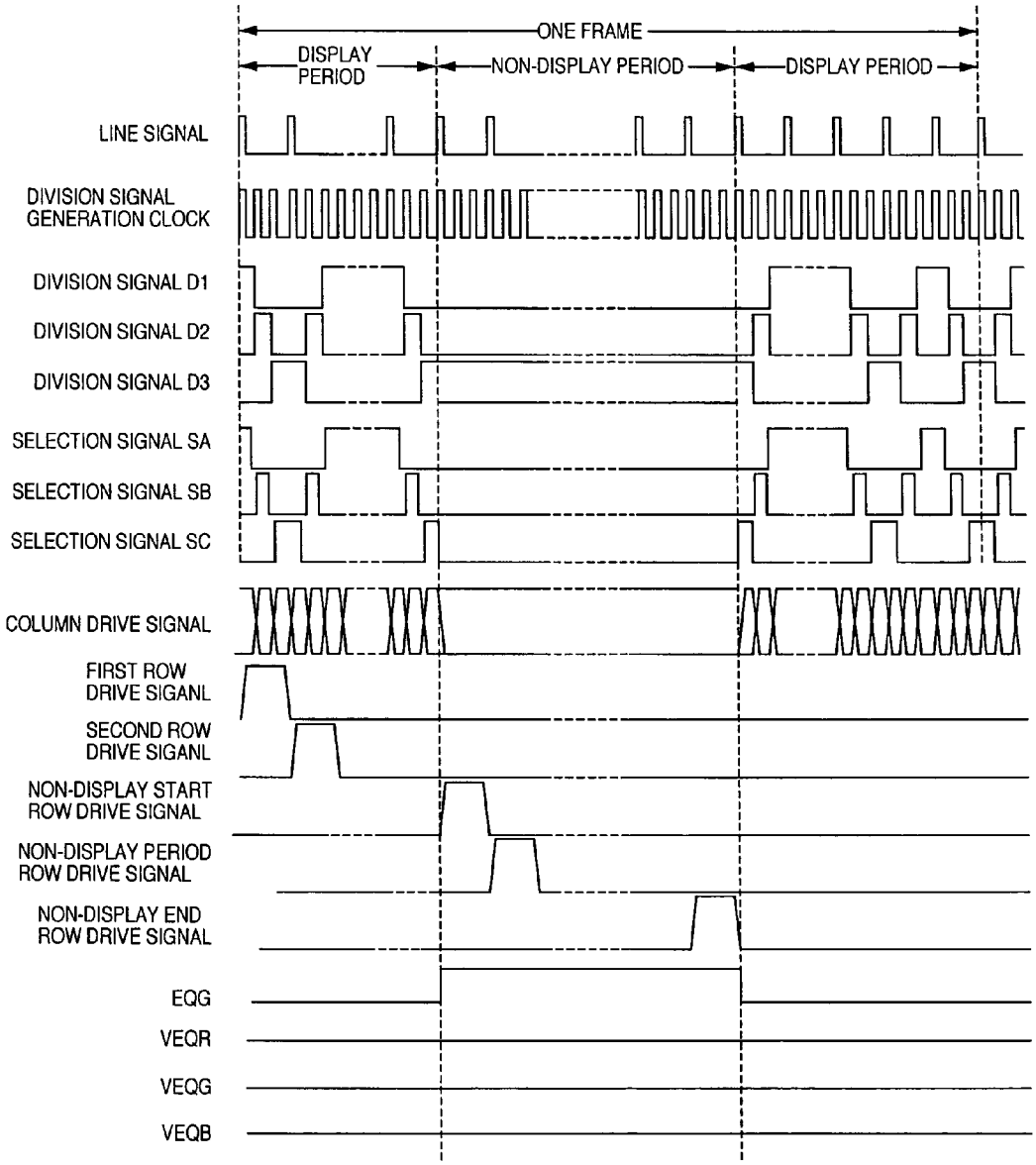
FIGS. 3A and 3B are a timing chart showing operation conducted at the time of partial display in the first embodiment, and a related diagram, respectively.
Figure 3B:
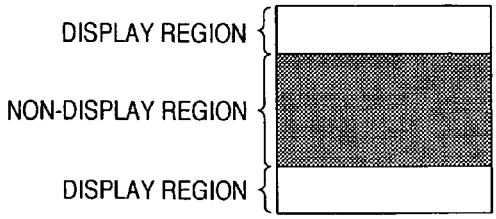
Figure 4:
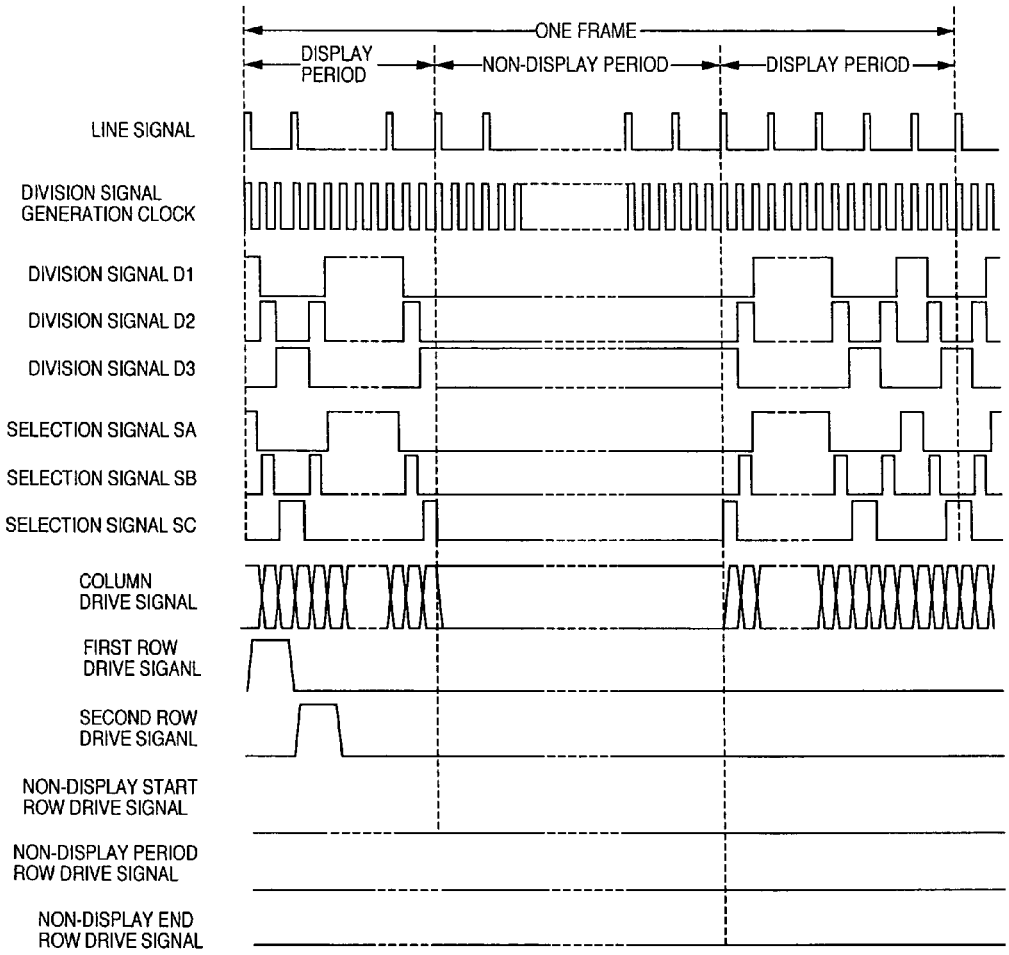
FIG. 4 is a timing chart showing operation conducted at the time of partial display in the first embodiment.

At this time, a row drive signal is output to each row as shown in FIG. 3A. As a result, a color associated with a voltage of low power dissipation, such as "black," is written into the non-display part. Here, the color written in differs depending upon the system of the liquid crystal, and it is not especially restricted.

If the value in the counter incorporated in the timing generator 113 has become equal to the value in the partial non-display end address register, the timing generator 113 turns on power supplies for the amplifiers in the column voltage output unit 118, and prepares for the ordinary operation. Furthermore, the timing generator 113 causes the input signal EQG of the equalizer circuit 124 to go low and returns the division signal D1, D2 and D3 to the waveforms in the ordinary operation.

Operation conducted in the second frame to the nth frame will now be described. The counter incorporated in the timing generator 113 is reset by the frame signal. The count in the counter increases by one each time the line signal goes high. If the value in the counter is lower than the value set in the partial non-display start address register, the ordinary operation is conducted.

If the value in the counter incorporated in the timing generator 113 has become equal to the value in the non-display start address register, the timing generator 113 causes the division signals D1, D2 and D3 to go low. Concurrently therewith, the timing generator 113 turns off power supplies for amplifiers in the column voltage output unit 118 and thereby prevents stationary currents from flowing to the amplifiers. The timing generator 113 causes the equalize signal EQG supplied to the equalizer circuit 124 to go high and fixes the VEQR, VEQG and VEQB signals to the potential level of the common electrode or a column voltage associated with "0." By doing so, the charging and discharging power becomes the lowest and it becomes possible to hold down the power dissipation to the minimum. At this time, the row drive signal is not output to each row during a non-display period as shown in FIG. 4. By doing so, the charging and discharging power of the row drive signal can be reduced remarkably. Since only the same color is written during the non-display period, there is no problem in display even if writing is thus conducted once every several frames.

In this way, operation is conducted in the order of RGB, BGR, RGB, . . . . In the display part of the partial display, therefore, the operation frequency of the selection signals SA and SC becomes half as compared with the case where operation is conducted in the order of RGB, RGB, RGB, . . . . On the whole, therefore, the frequency of the selection signals can be made equal to ⅔. The power charged and discharged by the TFT elements in the distributor 121 can be reduced to ⅔. In the non-display part of the partial display, the operation frequency of the selection signals SA, SB and SC becomes "0." In this way, the frequency can be made remarkably low. In the non-display part, the power consumption can be held down remarkably by turning off power supplies for a large number of amplifiers and fixing the column electrodes to the potential level of the common electrode or the column voltage associated with "0" by using the equalizer circuit.

Second Embodiment

Figure 6:
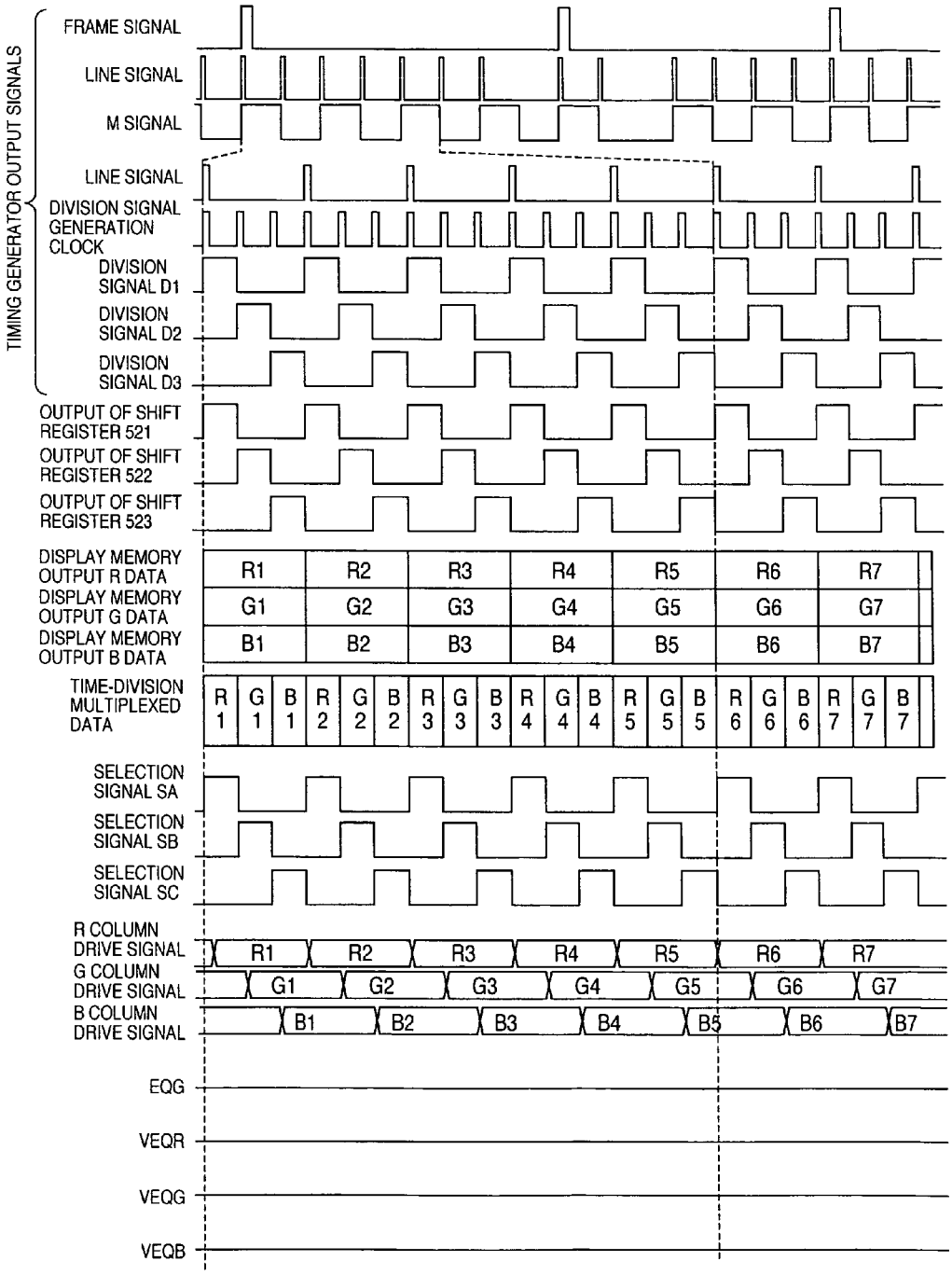
FIG. 6 is a timing chart showing operation conducted at the time of ordinary display in the second embodiment.
Figure 7:
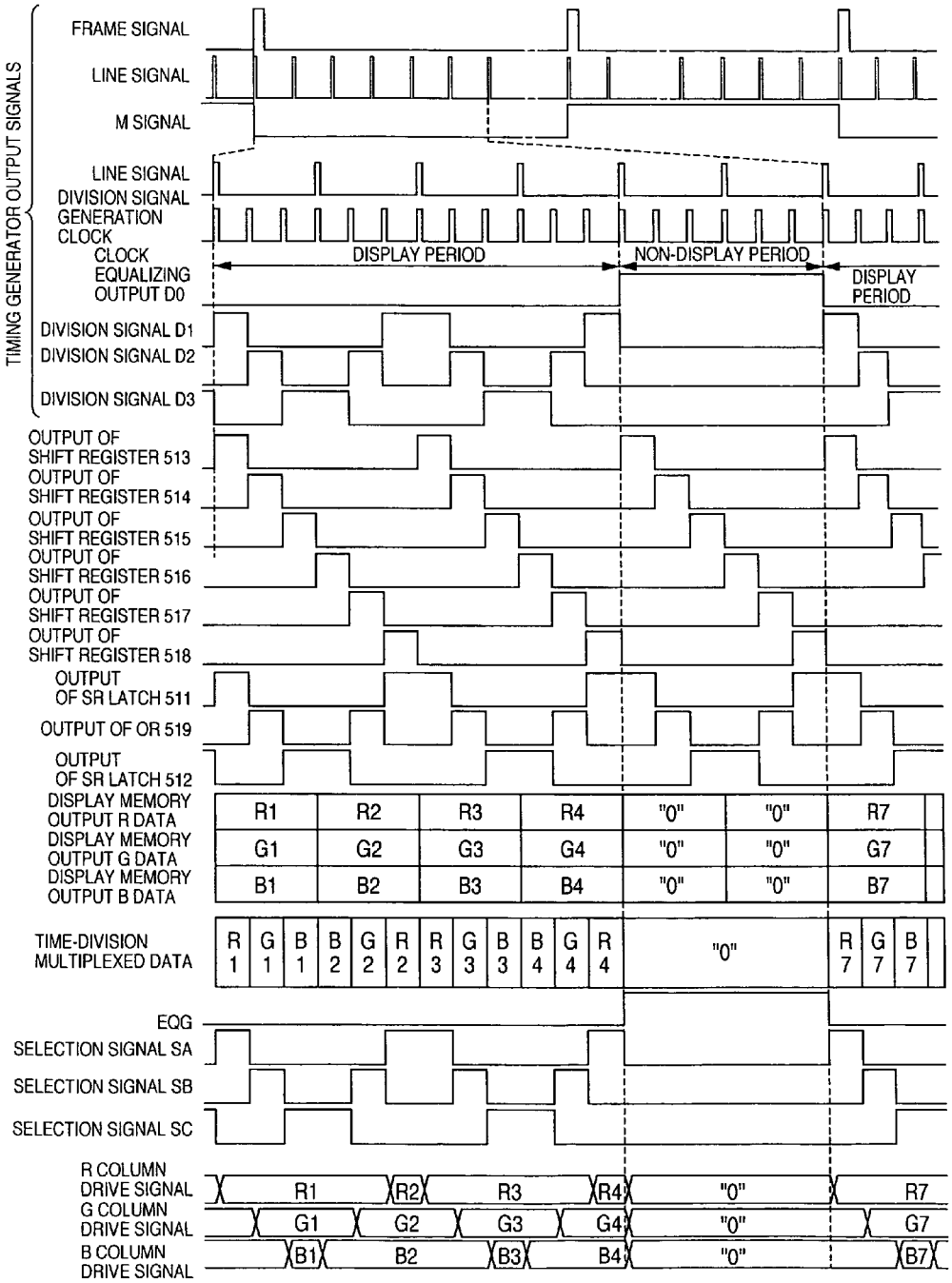
FIG. 7 is a timing chart showing operation conducted at the time of partial display in the second embodiment.

A second embodiment of the present invention will now be described with reference to FIGS. 1, 5, 6 and 7. The present embodiment differs from the first embodiment in that the order of time-division multiplexed data is definite as represented by RGB, RGB . . . as shown in FIG. 6 at the time of the ordinary operation. In addition, the present embodiment differs from the first embodiment in that line inversion is conducted, i.e., the potential level at the common electrode is inverted in phase every line at the time of the ordinary operation as shown in FIG. 6 and frame inversion is conducted, i.e., the potential level at the common electrode is inverted in phase every frame at the time of the partial display as shown in FIG. 7.

FIG. 1 was used in the description of the first embodiment. However, FIG. 1 is a block diagram which can be applied to the present embodiment as well. Unless otherwise stated in the ensuing description, each circuit has the same function and conducts the same operation as that in the first embodiment.

Figure 5:
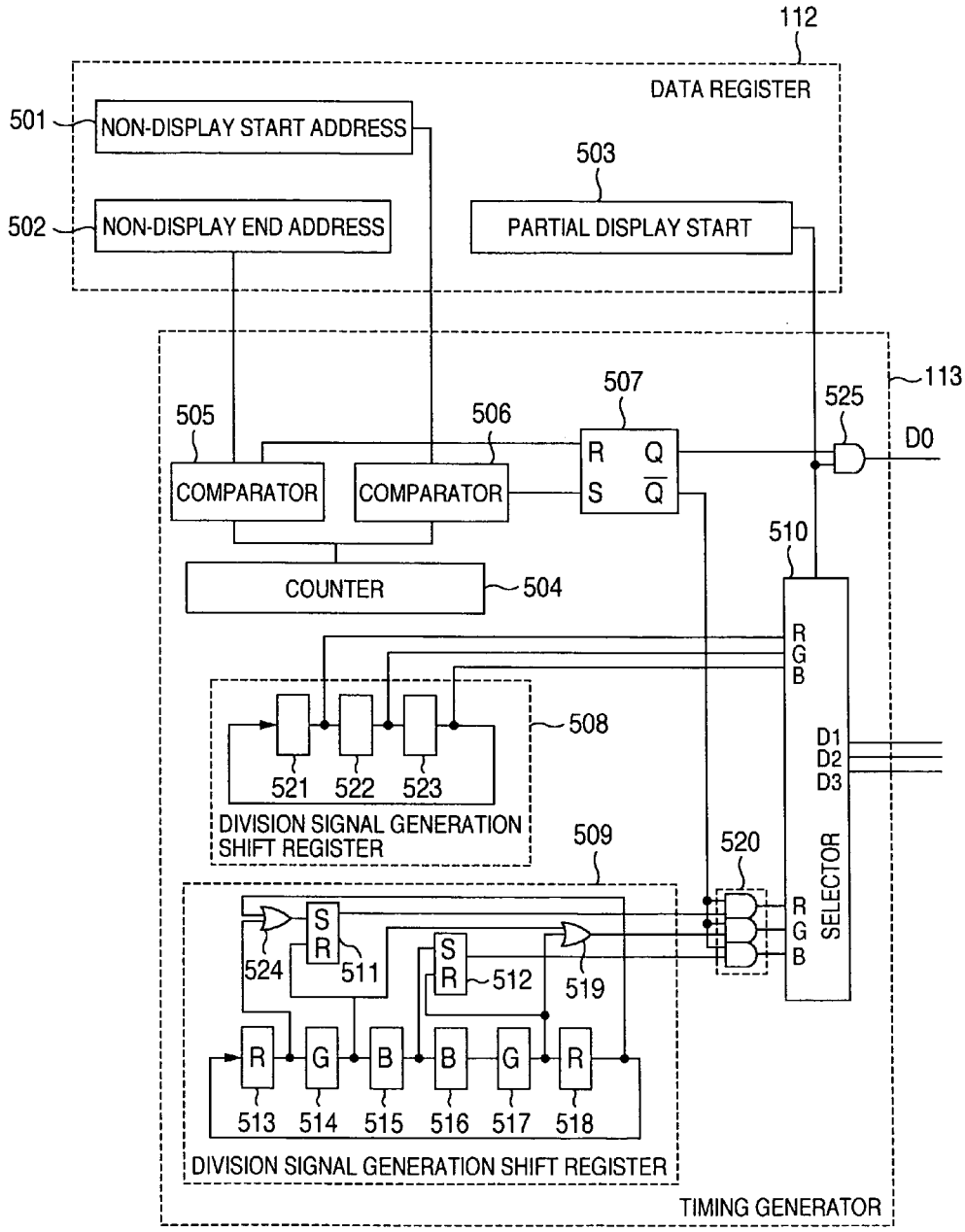
FIG. 5 is a detailed block diagram of parts of a data register and a timing generator in the second embodiment.

FIG. 5 is a block diagram showing a part of the data register 112 and the timing generator 113 in the present embodiment in detail. Reference numeral 501 denotes a non-display start address register for storing a non-display region start row number at the time of the partial display, 502 a non-display end address register for storing a non-display region end row number at the time of the partial display, 503 a partial display start register for indicating a partial display start state, and 504 a counter. Reference numerals 505 and 506 denote comparators, and 507, 511 and 512 SR latches. Reference numeral 508 denotes a time division signal generation shift register for ordinary display, 509 a time division signal generation shift register for partial display, and 510 a selector. Reference numerals 513 to 518 and 521 to 523 denote 1-bit shift registers, 519 and 524 OR circuits, and 520 and 525 AND circuits.

At the time of ordinary display, the partial display start register 503 shown in FIG. 5 has a value "0" and the selector 510 selects outputs of the time division signal generation shift register for ordinary display and outputs them to the division signals D1, D2 and D3. In the time division signal generation shift register for ordinary display 508, only a leftmost 1-bit shift register 521 is set to "H" and center and rightmost 1-bit shift registers 522 and 523 are set to "L." Shift operation is conducted by a division signal generation clock having a period obtained by dividing one period of the line signal into three equal parts. As a result, division signals D1, D2 and D3 shown in FIG. 6 are generated.

Selection signals SA, SB and SC shown in FIG. 6 are generated in the power supply unit 103 on the basis of the division signals D1, D2 and D3. The selection signals SA, SB and SC are formed to have shorter "H" time periods than those of the division signals D1, D2 and D3. An R column drive signal, a G column drive signal and a B column drive signal are fixed by the selection signals SA, SB and SC going low, respectively. Thereafter, the row drive signal goes low. Therefore, all of three colors R, G and B are written under the same condition of voltage applied to the liquid crystal elements. Even in the case of multi-gray scale display having 256 gray scale levels for each of R, G and B, therefore, color deviation by R, G and B is eliminated, resulting in beautiful display.

At the time of ordinary display, the partial display start register 503 has a value "0" and an equalize output D0 of the AND circuit 525 goes low. The EQG signal is formed on the basis of the output D0. At the time of the ordinary display, the EQG signal is always kept at "L." Therefore, the column electrodes are disconnected from the VEQR, VEQG and VEQB signals.

At the time of the partial display, eight-color display is conducted with two gray scale levels, i.e., two colors for each of R, G and B, and power supplied to a circuit for generating voltages of half tone (V1 to V254) incorporated in the column voltage generator 116 is disconnected, in order to reduce the power consumption. Hereafter, conducting the eight-color display with two colors for each of R, G and B at the time of the partial display is referred to as eight-color partial display.

The operation of the eight-color partial display will now be described with reference to FIGS. 5 and 7. In this partial display, the display screen is partitioned into three blocks in the longitudinal direction as shown in FIG. 3B. A center block is used as a non-display region, and upper and lower blocks are used as display regions.

At the time of the eight-color partial display, the partial display start register 503 has a value "1" and the selector 510 selects outputs of the division signal generation shift register for partial display 509 and outputs them as the division signals D1, D2 and D3. The AND circuit 525 outputs an output of the SR latch 507 as the equalize output D0.

In the division signal generation shift register for partial display 509, only the leftmost 1-bit shift register 513 is set to "H" and 1-bit shift registers 514 to 518 are set to "L" by the frame signal. The 1-bit shift registers 513 to 518 conduct shift operation according to a division signal generation clock generated so as to have a period obtained by dividing the period of the line signal into three equal parts. The SR latch 511 is an SR latch which is set to "H" when the 1-bit shift register 513 or 518 is "H" and reset to "L" when the 1-bit shift register 514 is "H." The SR latch 512 is an SR latch which is set to "H" when the 1-bit shift register 515 is "H" and reset to "L" when the 1-bit shift register 517 is "H."

The counter 504 is an increment counter which is set to 1 by the frame signal and incremented by one each time the line signal is input. A value in the counter 504 represents a row number which is currently subjected to writing. The comparator 505 compares the value in the counter 504 with a value in the non-display end address register 502. The comparator 505 outputs "H" only when they coincide with each other, and outputs "L" when they do not coincide with each other. The comparator 506 compares the value in the counter 504 with a value in the non-display start address register 501. The comparator 506 outputs "H" only when they coincide with each other, and outputs "L" when they do not coincide with each other. As a result, the RS latch 507 outputs "L" at its output Q and outputs "H" at its inverted output $\overline{Q}$ at the time of display row writing in the partial display. The RS latch 507 outputs "H" at its output Q and outputs "L" at its inverted output $\overline{Q}$ at the time of non-display row writing.

Since the start row of the frame is a display row, the inverted output $\overline{Q}$ of the RS latch 507 goes high. Therefore, outputs of the AND circuit 520 become the outputs of the time division signal generation shift register for partial display 509. The outputs of the selector 510 become division signals D1, D2 and D3 indicated in a display period shown in FIG. 7. The selection signals SA, SB and SC are formed in the power supply unit 103 on the basis of the division signals D1, D2 and D3.

The selection signals SA, SB and SC are formed to have shorter "H" time periods than those of the division signals D1, D2 and D3. In this case, the selection signal SA or SC is "H" when the row drive signal goes low. Strictly speaking, since the states of the column drive signal lines of the three colors R, G and B do not coincide, color deviations depending on R, G and B appear. Since eight-color display is conducted at the time of the partial display and only the lowest gray scale level and the highest gray scale level are used, however, some color deviation causes no anxiety and no problem is posed.

Since the start row of the frame is a display row, the Q output of the RS latch 507 goes low and the equalize output D0 of the AND circuit 525 goes low. The EQG signal formed in the power supply unit 103 on the basis of the output D0 also goes low. Therefore, the column electrodes are disconnected from the VEQR, VEQG and VEQB signals.

If writing into the display rows advances and the value in the counter 504 coincides with the value in the non-display start address register 501, the comparator 506 outputs "H" and consequently the inverted output $\overline{Q}$ goes low. Therefore, the output of the AND circuit 520 goes low. Accordingly, the division signals D1, D2 and D3 output from the selector 510 are fixed to "L" as indicated in the non-display period in FIG. 7.

Since the output Q of the SR latch 507 goes high, the equalize output D0 of the AND circuit 525 goes high. The output D0 is fixed to "H" as indicated in the non-display period in FIG. 7. The EQG signal formed in the power supply unit 103 on the basis of the output D0 also goes high. Therefore, the VEQR, VEQG and VEQB signals are applied to the column electrodes.

While the EQG signal is "H," the power supply unit 103 fixes voltages of the VEQR, VEQG and VEQB signals to a value which minimizes the power consumption, such as the potential level of the common voltage VCOM. The VEQR, VEQG and VEQB signals may be at a signal level associated with "0" as long as it is a value at which power is not consumed as far as possible. Therefore, the column electrodes assume a value at which the power consumption is minimized, such as the potential level of the common voltage VCOM. The column voltage output unit 118 turns off power supplies for amplifiers incorporated therein and thereby prevents stationary current from flowing to the amplifiers, while the equalize output D0 is "H."

If writing into the display rows advances and the value in the counter 504 coincides with the value in the non-display end address register 502, the comparator 505 outputs "H." Therefore, the output Q of the SR latch 507 goes low and the inverted output $\overline{Q}$ goes high. Accordingly, the division signals D1, D2 and D3 output from the selector 510 become the outputs of the time division signal generation shift register for partial display 509. The division signals D1, D2 and D3 have waveforms indicated in the display period in FIG. 7. The column voltage output unit 118 turns on power supplies for amplifiers incorporated therein and returns to the operation in the display period.

In this way, operation is conducted in the order of RGB, BGR, RGB, . . . . In the display period of the partial display, therefore, the operation frequency of the selection signals SA and SC becomes half as compared with the case where operation is conducted in the order of RGB, RGB, RGB, . . . . In the non-display period, the operation frequency of the selection signals SA, SB and SC becomes "0." In this way, the frequency can be made remarkably low, and consequently the power consumption can be held down remarkably. In addition, since the power supplies for amplifiers which need stationary currents and consume high power can be turned off, the power consumption can be reduced further remarkably. Furthermore, in the partial display, the division positions in the longitudinal direction can be set freely from the CPU, resulting in a display device which is convenient in use.

Third Embodiment

A third embodiment of the present invention will now be described with reference to FIGS. 8, 9 and 10. The present embodiment differs from the first and second embodiments in that data corresponding to six columns are subjected to time-division multiplexing and input as the time-division multiplexed data and a column voltage on one wire is connected to six column electrodes via six distribution switches.

Figure 8:
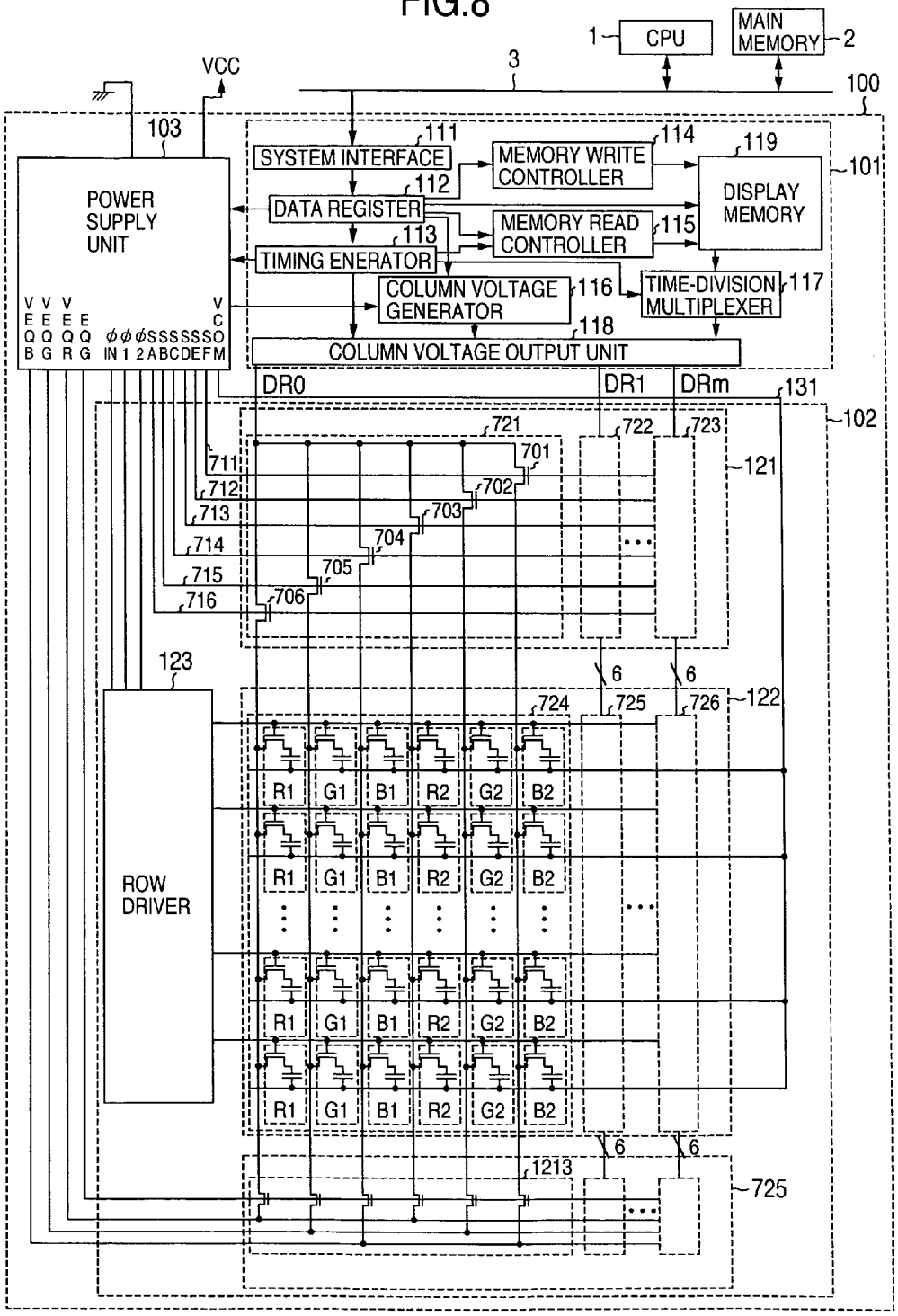
FIG. 8 is a block diagram showing a configuration of third and fourth embodiments of a display device according to the present invention.

FIG. 8 is a block diagram of a display device in the present embodiment. In the distributor 121 on the liquid crystal panel unit 102, switch circuits 721, 722 and 723 for converting one signal supplied from the column voltage output unit 118 to six column drive signals are provided. Since these switch circuits have the same configuration, the switch circuit 721 will now be described as a representative one. One signal supplied from the column drive circuit 101 is connected to switches 701, 702, 703, 704, 705 and 706. These switches are switches which are in the on-state when distribution control lines 711, 712, 713, 714, 715 and 716 are "H," respectively. The switches 701, 702, 703, 704, 705 and 706 supply column drive signals to pixels in B2, G2, R2, B1, G1 and R1 columns, respectively.

In the present embodiment, signals on a first column of R, a first column of G, a first column of B, a second column of R, a second column of G and a second column of B are time-division multiplexed as a column drive signal DR0, and a resultant signal is input to the liquid crystal panel unit. In the same way, signals on a third column and a fourth column of R, G and B are time-division multiplexed as a column drive signal DR1 and a resultant signal is input to the liquid crystal panel unit. Signals on a (2m+1)st column and a (2m+2) nd column of R, G and B are time-division multiplexed as a column drive signal DRm and a resultant signal is input to the liquid crystal panel unit.

Operation conducted at the time of the ordinary display will now be described with reference to FIG. 9. The display memory 119 in FIG. 8 outputs data corresponding to one row to the time-division multiplexer 117 in synchronism with the line signal. With reference to FIG. 9, especially operation of the first column and the second column will be described.

Figure 9:
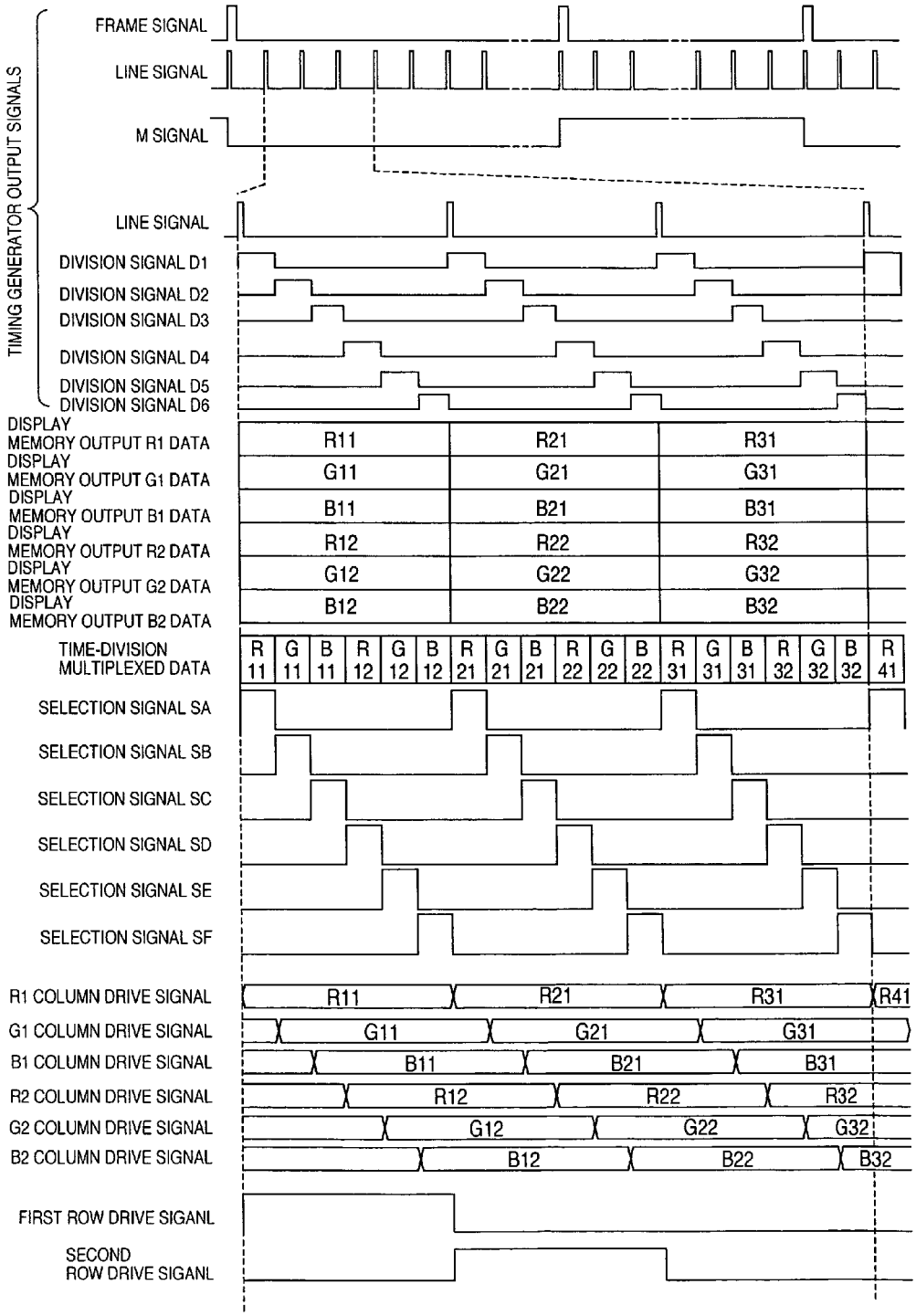
FIG. 9 is a timing chart showing operation conducted at the time of ordinary display in the third and fourth embodiments.

In FIG. 9, R11 denotes a value to be written into a first row of an R1 column. In the same way, R12 denotes a value to be written into the first row of an R2 column, and R21 denotes a value to be written into a second row of the R1 column.

Data in the first row are output simultaneously. Therefore, the time-division multiplexer 117 time-divides R11, G11, B11, R12, G12 and B12 in accordance with division signals D1 to D6 generated by the timing generator 113, and generated time-division multiplexed data. The time-division multiplexed data is converted to column voltages by the column voltage output unit 118, and output as the column drive signals DR0 to DRm.

The power supply unit 103 generates selection signals SA to SF on the basis of the division signals D1 to D6. When the selection signal SA is "H," the switch 706 is in the on-state. At that time, the column voltage has a value associated with R11. Therefore, the column voltage R11 is written into the R1 column. In the same way, G11, B11, R12, G12 and R12 are written into the G1 column, B1 column, R2 column, G2 column and R2 column, respectively. After a drive signal for the last B2 column is fixed, a row drive signal for the first row goes low. Column voltages associated with R11, G11, B11, R12, G12 and B12 are written into liquid crystal pixels in the R1th, G1th, B1th, R2th, G2th and B2th columns of the first row, respectively.

Owing to such a configuration, the number of wires between the column driver 101 and the liquid crystal panel unit 102 can be reduced to half in the liquid crystal device in the present embodiment as compared with the liquid crystal display devices in the first and second embodiments. The cost is thus reduced.

Operation conducted at the time of eight-color partial display will now be described with reference to FIG. 10. In the display period, the display memory 119 in FIG. 8 outputs data corresponding to one row to the time-division multiplexer 117 in synchronism with the line signal. Data in the first row are output simultaneously. Therefore, the time-division multiplexer 117 time-divides R11, G11, B11, R12, G12 and B12 in accordance with the division signals D1 to D6 generated by the timing generator 113, and thereby generates time-division multiplexed data. At this time, the division signals D1 to D6 have waveforms shown in FIG. 10. In the first row, therefore, the time-division multiplexed data is time-division multiplexed in the order of R11, G11, B11, R12, G12 and B12. In the second row, the time-division multiplexed data is time-division multiplexed in the order of B22, G22, R22, B21, G21 and R21.

Figure 10:
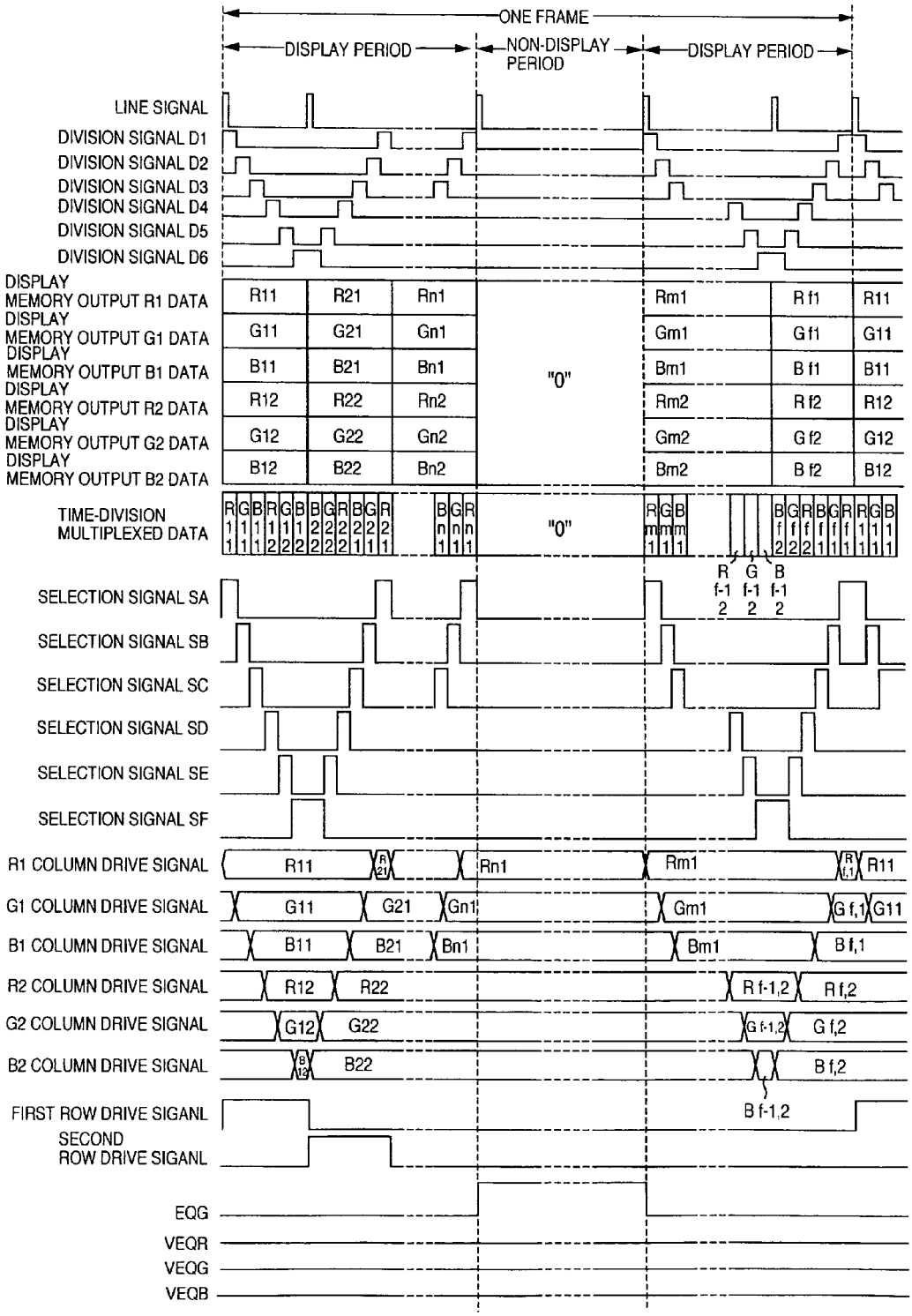
FIG. 10 is a timing chart showing operation conducted at the time of eight-color partial display in the third embodiment.

The selection signals SA to SF are generated on the basis of the division signals D1 to D6, and the selection signals SA to SF have waveforms shown in FIG. 10. When column voltages associated with R11, G11, B11, R12, G12 and B12 are written into the R1th, G1th, B1th, R2th, G2th and B2th columns, respectively, therefore, the row drive signal for the first row goes low. Accordingly, column voltages associated with R11, G11, B11, R12, G12 and B12 are written into liquid crystal pixels in the R1th, G1th, B1th, R2th, G2th and B2th columns of the first row, respectively. As for the second row, the row drive signal for the second row goes low. when column voltages associated with R21, G21, B21, R22, G22 and B22 are written into the R1th, G1th, B1th, R2th, G2th and B2th columns, respectively. Accordingly, column voltages associated with R21, G21, B21, R22, G22 and B22 are written into liquid crystal pixels in the R1th, G1th, B1th, R2th, G2th and B2th columns of the second row, respectively.

The present embodiment has heretofore described. In the first row, the selection signal SF for driving the B2 column goes high lastly and the column voltage is distributed to the B2 column lastly. Thereafter, in the second row, the selection signal SF goes high first and the column voltage is distributed to the B2 column first.

In the second row, the selection signal SA for driving the R1 column goes high lastly and the column voltage is distributed to the R1 column lastly. Thereafter, in the third row, the selection signal SA goes high first and the column voltage is distributed to the R1 column first.

In this way, a column which has received distribution lastly in a certain row receives distribution first in the next row. During the change of the row, the selection signal is kept at "H." Therefore, the drive frequency of the selection signals SA and SF can be reduced to half. As a result, the charging and discharging power of the selection signals SA and SF can be reduced to approximately half. Furthermore, in the present embodiment as well, the level of the selection signals SA to SF are fixed to "L" in the non-display period and consequently the drive frequency in the non-display period can be made "0" in the same way as the first and second embodiments. Furthermore, in the non-display period, the EQG signal of the equalizer circuit is set to "H" and the power supplies for the amplifiers in the column voltage output unit can be turned off. Therefore, the power consumption can be reduced remarkably.

In the present embodiment, the selection signal goes high in the order of SA, SB, SC, SD, SE and SF in an odd-numbered row, whereas the selection signal goes high in the order of SF, SE, SD, SC, SB and SA, i.e., in the reversed order in an even-numbered row. For example, it is apparent that similar effects can be obtained even if the selection signal goes high in the odd-numbered row in the order of SA, SB, SC, SD, SE and SF and the selection signal goes high in the even-numbered row in the order of SF, SB, SC, SD, SE and SA. Selection orders other than the first and the last columns do not give any restriction to the present invention. The number of time divisions is 3 in the first and second embodiments, and 6 in the third embodiment. However, the number of time divisions may not be a multiple of 3. It is apparent that the same effects can be obtained even if a different number is used, by first giving distribution to a column which has received distribution lastly in a certain row, in the next row. Therefore, the number of time divisions does not give any restriction to the present invention. Whatever integer the number of time divisions is, the present invention can be applied.

Fourth Embodiment

Figure 11:
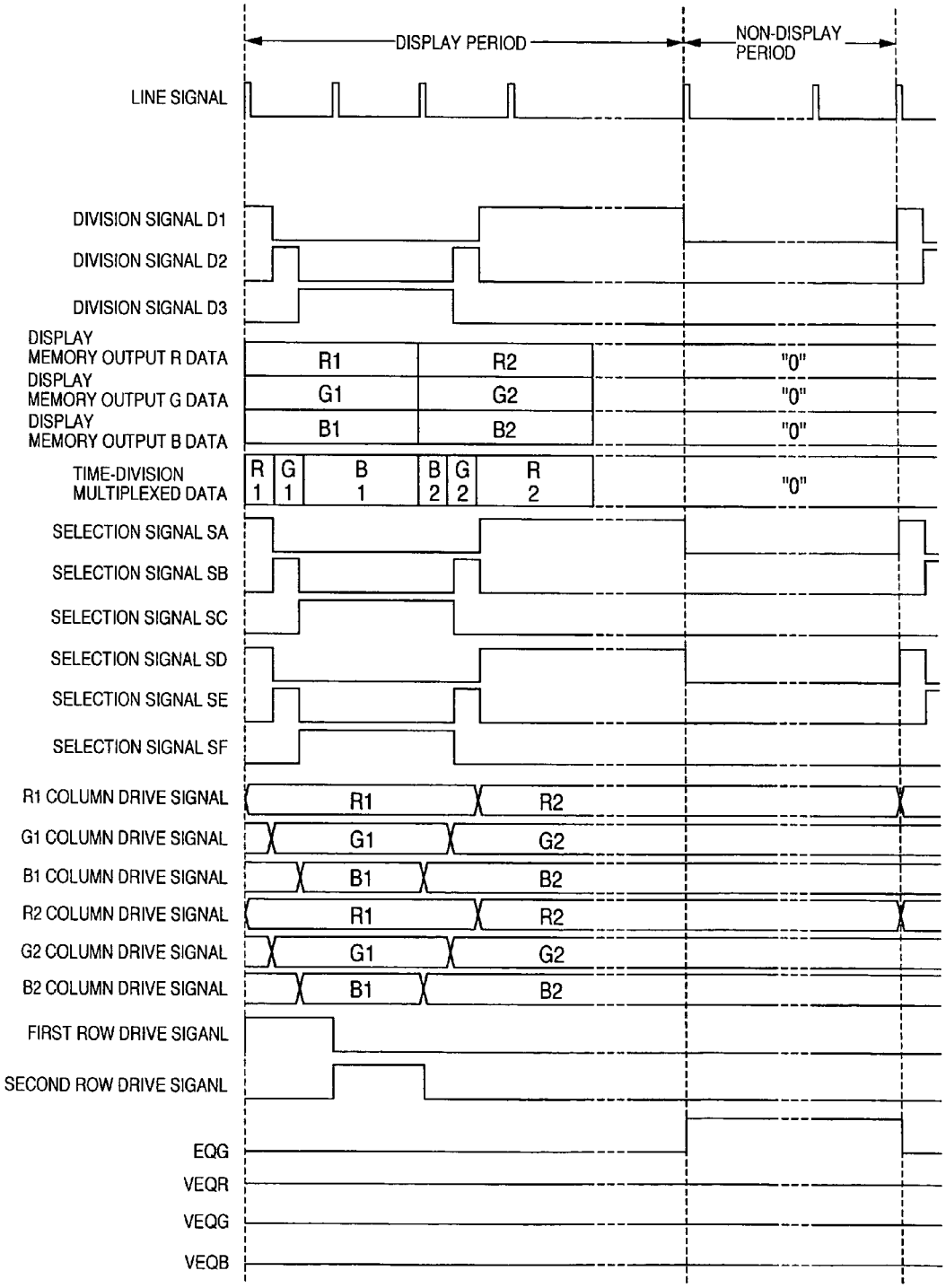
FIG. 11 is a timing chart showing operation conducted at the time of eight-color partial display in the fourth embodiment.

A fourth embodiment of the present invention will now be described with reference to FIGS. 8, 9 and 11. FIG. 8 is a block diagram of the present embodiment in the same way as the third embodiment. In the present embodiment, the operation shown in FIG. 9 is conducted at the time of ordinary display in the same way as the third embodiment. In the present embodiment, operation shown in FIG. 11 is conducted at the time of eight-color partial display.

In the eight-color partial display in the present embodiment, display is conducted at a resolution of ½ in both the longitudinal and lateral directions. For example, if high definition display with VGA (640 pixels×480 pixels) is conducted at the time of the ordinary display, QVGA (320 pixels×240 pixels) display is conducted at the time of the eight-color partial display. Such lowered definition is conducted by writing the same value into two pixels in the longitudinal direction and two pixels in the lateral direction, i.e., four pixels in total.

First, the display memory 119 in FIG. 8 outputs data to be written into the first row and the second row to the time-division multiplexer 117. The timing generator 113 generates division signals D1, D2 and D3 shown in FIG. 11.

At the time of writing into the first row, one line period is divided into three parts. A first period obtained by dividing into three parts is set to an "H" period of the division signal D1, a second period is set to an "H" period of the division signal D2, and a third period is set to an "H" period of the division signal D3. Time-division multiplexed data is generated on the basis of the division signals D1, D2 and D3 as shown in FIG. 11. Selection signals SA to SF are generated on the basis of the division signals D1, D2 and D3. The same signal is output as selection signals SA and SD. The same signal is output as selection signals SB and SE. The same signal is output as selection signals SC and SF. As a result, the same column voltage is written into the R1 column and the R2 column. The same column voltage is written into the G1 column and the G2 column. The same column voltage is written into the B1 column and the B2 column. After respective column voltages are fixed, a first row drive signal goes low. A column voltage R1 is written into the R1 column and the R2 column of the first row of liquid crystal pixels. A column voltage G1 is written into the G1 column and the G2 column of the first row of liquid crystal pixels. A column voltage B1 is written into the B1 column and the B2 column of the first row of liquid crystal pixels.

At the time of writing into a second row, output data of the display memory 119 and the division signals D1, D2 and D3 do not change and potentials of the selection signals SA to SF are maintained. As a result, potentials of the column drive signals of liquid crystal elements R1, G1, B1, R2, G2 and B2 do not change. A second row drive signal goes low. A column voltage R1 is written into the R1 column and the R2 column of the second row of liquid crystal pixels. A column voltage G1 is written into the G1 column and the G2 column of the second row of liquid crystal pixels. A column voltage B1 is written into the B1 column and the B2 column of the second row of liquid crystal pixels.

At the time of writing into a third row, one line period is divided into three parts. A first period obtained by dividing into three parts is set to an "H" period of the division signal D3, a second period is set to an "H" period of the division signal D2, and a third period is set to an "H" period of the division signal D1. Time-division multiplexed data is generated in the order of B2, G2 and R2 as shown in FIG. 11 on the basis of the division signals D1, D2 and D3. The selection signals SA to SF are generated on the basis of the division signals D1, D2 and D3. The same signal is output as selection signals SA and SD. The same signal is output as selection signals SB and SE. The same signal is output as selection signals SC and SF. As a result, the same column voltage is written into the R1 column and the R2 column. The same column voltage is written into the G1 column and the G2 column. The same column voltage is written into the B1 column and the B2 column. After respective column voltages are fixed, a third row drive signal goes low. A column voltage R2 is written into the R1 column and the R2 column of the third row of liquid crystal pixels. A column voltage G2 is written into the G1 column and the G2 column of the third row of liquid crystal pixels. A column voltage B2 is written into the B1 column and the B2 column of the third row of liquid crystal pixels.

Operation is conducted as heretofore described. In the eight-color partial display, therefore, the operation frequency of the selection signals SB and SE becomes half as compared with that at the time of the ordinary display shown in FIG. 8. The operation frequency of the selection signals SA, SC, SD and SF becomes a quarter as compared with that at the time of the ordinary display. Since the operation frequency can be reduced remarkably, the power consumption can be lowered.

In the display period of the eight-color partial display in the present embodiment, "H" in the row drive signal is input at different timing row by row. Alternatively, the time of "H" may be lengthened to twice and "H" in the row drive signal for two rows may be input simultaneously. The input system of the row drive signal is not especially restricted.

As heretofore described in the present embodiment, the present system can also be applied to a display method in which the same data is written into a plurality of rows and write data is changed every plural rows. A column which has received distribution lastly in a row in which display is changed over receives distribution first in the next row in which the display is changed over. In addition, at the time of row changeover or in a row in which the display is not changed over, the potentials of the selection signals are maintained.

Heretofore, the embodiments of the present invention have been described by taking TN liquid crystal and the LTPS-TFT as an example. However, it is a matter of course that the embodiments can be applied to display devices using other liquid crystal systems, such as IPS liquid crystal and OCB liquid crystal, or other display principles such as OLED, as long as they are display devices in which display signals to display pixels are time-division multiplexed, input, distributed, written and displayed.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

a pixel unit formed by forming a common electrode on an inner surface of one of two substrates disposed so as to be opposed to each other across a liquid crystal layer, forming a plurality of row electrodes and a plurality of column electrodes intersecting each other on an inner surface of the other of the two substrates, forming three-terminal switching elements respectively at intersections of the row electrodes and the column electrodes, connecting a first terminal of each of the switching elements to one of the row electrodes, connecting a second terminal of the switching element to one of column electrodes, connecting a third terminal of the switching element to one end of the liquid crystal layer and a retained capacitance, and connecting the other end of the liquid crystal layer to the common electrode;

a column drive circuit for converting display data input from an external device to a column voltage, generating a display synchronizing signal for liquid crystal drive, conducting time-division multiplexing on column voltages associated with one row in accordance with the display synchronizing signal, and outputting resulting time-division multiplexed column voltages;

a distributor circuit for distributing the time-division multiplexed column voltages supplied from the column drive circuit and outputting the distributed column voltages to the column electrodes;

a row drive circuit for outputting row voltages to the row electrodes row by row in accordance with the display synchronizing signal, in order to control turning on/off of the switching elements; and a power supply circuit for outputting the display synchronizing signal to the row drive circuit, outputting a common voltage to the common electrode, and outputting selection signals to the distributor circuit, wherein a first column electrode selected lastly in a frame, when a selection signal is in a selection state, for an arbitrary row electrode is selected first for a next row electrode in said frame and the first column electrode selected lastly in said frame for the arbitrary row electrode is kept selected, and the selection signal remains in said selection state, until a different second column electrode is selected for the next row electrode in said frame, wherein said frame comprises a period from a frame signal to a next frame signal.

2. The display device according to claim 1, further comprising a changeover function for changing over the following cases A and B:

case A: when the selection signals are not changed in level, display is conducted with a small number of gray scale levels, case B: when the selection signals are changed in level, display is conducted with a large number of gray scale levels.

3. A display device comprising:

a pixel unit formed by forming a common electrode on an inner surface of one of two substrates disposed so as to be opposed to each other across a liquid crystal layer, forming a plurality of row electrodes and a plurality of column electrodes intersecting each other on an inner surface of the other of the two substrates, forming three-terminal switching elements respectively at intersections of the row electrodes and the column electrodes, connecting a first terminal of each of the switching elements to one of the row electrodes, connecting a second terminal of the switching element to one of column electrodes, connecting a third terminal of the switching element to one end of the liquid crystal layer and a retained capacitance, and connecting the other end of the liquid crystal layer to the common electrode;

a column drive circuit for converting display data input from an external device to a column voltage, generating a display synchronizing signal, conducting time-division multiplexing on column voltages associated with one row in accordance with the display synchronizing signal, and outputting resulting time-division multiplexed column voltages;

a distributor circuit for distributing the time-division multiplexed column voltages supplied from the column drive circuit and outputting the distributed column voltages to the column electrodes;

a row drive circuit for outputting row voltages to the row electrodes row by row in accordance with the display synchronizing signal, in order to control turning on/off of the switching elements; and a power supply circuit for outputting the display synchronizing signal to the row drive circuit, outputting a common voltage to the common electrode, and outputting selection signals to the distributor circuit, wherein:

the display data is changed over every plural rows, and a first column electrode selected lastly in a frame, when a selection signal is in a selection state, for an arbitrary row electrode is selected first for a next row electrode in said frame and the first column electrode selected lastly in said frame for the arbitrary row electrode is kept selected, and the selection signal remains in said selection state, until a different second column electrode is selected for the next row electrode in said frame, wherein said frame comprises a period from a frame signal to a next frame signal.

4. A display device comprising:

a plurality of row electrodes;

a plurality of column electrodes intersecting the row electrodes;

display elements arranged in the intersections of the row electrodes and the column electrodes; and a distributor circuit for selecting column electrodes by using a division unit obtained by dividing the column electrodes into a plurality of parts, wherein:

the distributor circuit successively selects respective column electrodes with the division unit in accordance with a plurality of selection signals, and a first column electrode selected lastly in a frame, when a selection signal is in a selection state, for an arbitrary row electrode is selected first for a next row electrode in said frame and the first column electrode selected lastly in said frame for the arbitrary row electrode is kept selected, and the selection signal remains in said selection state, until a different second column electrode is selected for the next row electrode in said frame, wherein said frame comprises a period from a frame signal to a next frame signal.

5. The display device according to claim 4, wherein over a non-display period in partial display, the selection signals are kept in an off-state.

6. A display device comprising:

a pixel unit formed so as to be associated with switching elements formed respectively at intersections of a plurality of row electrodes and a plurality of column electrodes, and a common electrode;

a column drive circuit for converting display data input from an external device to a column voltage, generating a display synchronizing signal, conducting time-division multiplexing on column voltages associated with one row in accordance with the display synchronizing signal, and outputting resulting time-division multiplexed column voltages;

a distributor circuit for distributing the time-division multiplexed column voltages supplied from the column drive circuit and outputting the distributed column voltages to the column electrodes;

a row drive circuit for outputting row voltages to the row electrodes row by row in accordance with the display synchronizing signal, in order to control turning on/off of the switching elements; and a power supply circuit for outputting the display synchronizing signal to the row drive circuit, outputting a common voltage to the common electrode, and outputting selection signals to the distributor circuit, wherein a first column electrode selected lastly in a frame, when a selection signal is in a selection state, for an arbitrary row electrode is selected first for a next row electrode in said frame and the first column electrode selected lastly in said frame for the arbitrary row electrode is kept selected, and the selection signal remains in said selection state, until a different second column electrode is selected for the next row electrode in said frame, wherein said frame comprises a period from a frame signal to a next frame signal.

* * * * *